US009497557B2

(12) United States Patent
Athalye et al.

(10) Patent No.: US 9,497,557 B2
(45) Date of Patent: Nov. 15, 2016

(54) RFID-EQUIPPED HEARING AID RETAINER

(71) Applicant: Scandent LLC, Stony Brook, NY (US)

(72) Inventors: Akshay Athalye, Forest Hills, NY (US); Vladimir Djuric, New York, NY (US)

(73) Assignee: Scandent LLC, New York, NY (US)

( * ) Notice: Subject to any disclaimer, the term of this patent is extended or adjusted under 35 U.S.C. 154(b) by 0 days.

(21) Appl. No.: 14/598,010

(22) Filed: Jan. 15, 2015

(65) Prior Publication Data

US 2015/0201282 A1 Jul. 16, 2015

Related U.S. Application Data

(60) Provisional application No. 61/927,977, filed on Jan. 15, 2014.

(51) Int. Cl.
*H04R 25/00* (2006.01)

(52) U.S. Cl.
CPC ..... *H04R 25/65* (2013.01); *H04R 2460/17* (2013.01)

(58) Field of Classification Search
USPC ..... 381/315
See application file for complete search history.

(56) References Cited

U.S. PATENT DOCUMENTS 3,010,365 A * 11/1961 Sadel ..... G02C 5/143 351/111
3,327,807 A 6/1967 Mullin
4,702,345 A 10/1987 Janssen et al.
4,881,616 A 11/1989 Janssen et al.
4,918,757 A 4/1990 Janssen et al.
5,327,499 A 7/1994 Sohayda
5,721,783 A 2/1998 Anderson
7,484,845 B2 * 2/2009 Douglas ..... A42B 1/247 2/209.13
8,094,848 B1 1/2012 Frerking et al.
8,189,835 B2 5/2012 Dietz
8,199,946 B2 6/2012 Ritter et al.
2002/0029438 A1 3/2002 Cereceres
2006/0251280 A1 11/2006 Fennell et al.
2007/0217641 A1 9/2007 Rosal
2011/0121082 A1 * 5/2011 Phaneuf ..... G06K 19/041 235/492
2011/0224481 A1 * 9/2011 Lee ..... G02C 11/06 600/25

(Continued)

FOREIGN PATENT DOCUMENTS

WO WO2010108492 9/2010

*Primary Examiner* — Amir Etesam

(57) ABSTRACT

This invention provides an RFID-equipped retainer for hearing aids. In one embodiment, the retainer consists of a hollow string or tube. Located at one end of the retainer is a clasp that can attach to a hearing aid, and at the other end is a clip or similar fastener for optionally attaching the retainer to the clothing of the wearer. Also provided are the designs for passive and battery-assisted-passive, ultra high frequency, far-field RFID tags that can be embedded within this retainer. The tags consist of an RFID microchip with an impedance matching circuit mounted on a substrate and an antenna connected to the microchip. In another embodiment, the retainer consists of an RFID tag enclosed in a package or case that sits behind the wearer's ear and is physically connected to the hearing aid in the ear. The RFID microchip can be optionally programmed with an identification number that can be associated with information about the hearing aid to which it is attached. The identification number of the microchip can be read by an RFID reader at a distance of up to 10 feet or more. Also provided is an RFID system intended to be used in conjunction with the RFID-equipped hearing aid retainers to facilitate loss prevention, detection, tracking and identification of hearing aids.

10 Claims, 7 Drawing Sheets

(56) References Cited

U.S. PATENT DOCUMENTS

| | | | | |
|---|---|---|---|---|
| 2013/0101148 | A1 | 4/2013 | Karlsen | |
| 2013/0121519 | A1 | 5/2013 | Karlsen | |
| 2013/0243228 | A1 | 9/2013 | Müller | |
| 2013/0343586 | A1 | 12/2013 | Kvist et al. | |
| 2014/0332597 | A1* | 11/2014 | Gelinotte | G06K 19/047 235/492 |

* cited by examiner

RFID-EQUIPPED HEARING AID RETAINER

CROSS-REFERENCE TO RELATED APPLICATIONS

This application claims the benefit under 35 U.S.C. §119 (e) of U.S. Provisional Application Ser. No. 61/927,977, filed on Jan. 15, 2014, which is hereby incorporated by reference herein in its entirety.

FIELD OF THE INVENTION

The invention relates to a Radio Frequency Identification (RFID)-equipped retainer for hearing aids. The retainer can be in the form of a string with an embedded RFID tag or in the form of an RFID tag packaged in a device that sits behind the ear of the wearer.

BACKGROUND OF THE INVENTION

It is estimated that a significant majority of residents living in long-term care facilities suffer from some degree of hearing loss, and many of these residents use hearing aids on a daily basis. In nursing home environments, the loss of hearing aids is a common and expensive problem, and it is particularly severe in nursing home units that provide care for residents suffering from dementia and other cognitive impairments. Often, hearing aids are accidentally thrown into the garbage by residents or staff, inadvertently removed with clothing going to the laundry, left in bedsheets, or simply misplaced in dressers and closets. The loss of hearing aids not only incurs a high cost of replacement, often in the thousands of dollars, but it also adversely affects resident quality of life, and consumes a lot of staff time spent looking for missing hearing aids, processing claims, and resolving disputes with residents' families.

Today, the problem of hearing aid loss persists in these facilities without an effective, practical solution. Therefore, a technological solution that can prevent hearing aid loss and help find misplaced hearing aids is strongly desired by all types of long-term senior care facilities.

Hearing aids are available in various sizes and form factors. They can be classified based on their position with respect to the ear of the wearer. The most common styles in use today are behind-the-ear (BTE), in-the-ear (ITE), and in-the-canal (ITC) hearing aids.

Several hearing aid manufacturers provide string-based retainers (sometimes referred to as "oto-clips") for use with hearing aids. One end of the oto-clip attaches to the hearing aid and the other end is attached to the clothing of the hearing aid wearer. These devices are available from commercial retailers such as Westone Labs, Harris Communications and Sound Clarity, among others. Other types of mechanical retainers have also been disclosed.

Various types of hearing aid retainers have been previously disclosed. US20070217641A1 discloses a retainer in the form of a flexible sleeve that wraps around the hearing aid and a flexible cord that connects the sleeve to the clothing of the wearer. U.S. Pat. Nos. 4,881,616 and 4,702,345 disclose a sleeve-like retainer with a cord that wraps around the ear of the wearer. US 20130121519 A1 discloses another retainer for behind-the-ear (BTE) hearing aids in the form of a cord that wraps around the ear of the wearer. US 20130101148 A1 discloses a retainer for BTE hearing aids in the form of a battery compartment connected to a retainer accessory that fits under the ear of the wearer. US 20060251280 A1 discloses a retainer in the form of a cord that connects to a hook on the hearing aid wherein the cord can be worn around the neck of the wearer.

In related prior art, U.S. Pat. No. 5,327,499 describes a safety device in the form of a small chain, one end of which attaches to the hearing aid and the other end to an earring or other such device worn by the wearer. US 20020029438A1 discloses a hearing aid strap that is intended to prevent the hearing aid from accidentally falling out of the ear while the wearer is physically active. In a similar vein, U.S. Pat. Nos. 4,918,757 and 3,327,807 disclose retainers in the form of headbands and headsets.

While these retainers, to some degree, help in keeping hearing aids in place on the wearer and prevent them from falling to the floor and being damaged, they fail to provide protection against hearing aids being permanently lost after they get misplaced, thrown in the garbage, or left in clothing in long-term care environments.

Radio Frequency Identification (RFID) is a technology for the automated remote identification of objects. A typical RFID system consists of RFID tags that are attached to objects of interest and RFID readers that remotely read the information contained in the tags. Today, RFID technology has widespread applications in areas such as inventory management, asset tracking, access control, and payment systems.

Various enterprises use RFID technology for tracking assets and equipment within facility premises. Such systems typically consist of RFID readers deployed throughout the facility and RFID tags attached to assets that need to be tracked. The main motivation behind using such systems is to prevent loss and theft of certain assets and reduce the time required to locate them.

The use of RFID technology in conjunction with hearing aids for various applications, including loss detection and prevention, has been previously explored. U.S. Pat. No. 8,189,835B2 describes a loss detection system for hearing aids consisting of an RF transmitter in the hearing aid that continuously transmits a signal to a receiver device worn on the body of the wearer. If the receiver detects an absence of this signal, it alerts the wearer to possible loss of the hearing aid. US 20130243228A1 discloses a hearing aid detection system comprised of a near-field communication (NFC) tag embedded within the hearing aid and a detection unit capable of communicating with this NFC tag at close range (four inches).

U.S. Pat. Nos. 5,721,783, 8,094,848B1, and 8,199,946B2, and Patent Applications No. US20130343586A1 and WO2010108492A1 disclose various systems based on RF communication involving a transponder-receiver pair, one of which is embedded within the hearing aid. These systems enable data communication between an external device and the hearing aid to enable various functions, including the modification of hearing aid amplification, adaptation of a hearing aid to its environment, and the use of a mobile phone in conjunction with the hearing aid. All of these systems use near-field communication, which limits the communication distance between the transponder and receiver to around four inches or less.

RFID technology has been widely used as a solution for asset loss and misplacement. The tags used for such systems can either be active, wherein the tag itself transmits a radio signal that is detected by a reader, or passive, wherein a tag gets energized by the signal transmitted by a reader and communicates by reflecting part of the signal back to the reader. The read range of the tags varies from 6 to 15 feet in the case of passive tags, to more than 30 feet in case of active tags. However, given the small size and customized shape of hearing aids, these commercial tags cannot be directly attached to or embedded into hearing aids.

In order for an RFID system to be used for preventing the loss of hearing aids in the long-term care facility environments described earlier, it is essential that the RFID tag designed for the hearing aid can be detected by an RFID reader at a long distance (10 feet or more). This communication distance is essential to the viability of the solution. Furthermore, the designed RFID tag should not affect the fit, feel, battery life, or performance of the hearing aid. It should also not interfere with the functioning of the sound processing and wireless communication devices involved in the normal operation of the hearing aid.

It is the objective of this invention to overcome these barriers and provide an RFID-equipped retainer for hearing aids that can form the basis of an RFID loss prevention system for nursing home and assisted living facility environments, and for hospital and residential settings as well.

SUMMARY OF THE INVENTION

The present invention describes an RFID-equipped retainer for hearing aids and its various possible embodiments. Also presented is an RFID tag designed for being embedded into the retainer body. The RFID tag consists of an RFID microchip and associated impedance matching and feeding circuitry mounted on a substrate, and a wire dipole antenna that is connected to the microchip. The RFID tag does not include an active radio transceiver and instead operates using far-field backscatter-based communication.

In one embodiment, the retainer is in the form of a hollow string or tube made from a non-conductive material such as cloth (e.g. nylon), plastic, rubber, or silicone, with one end attached to the hearing aid, and the other end optionally attached to clothing. The RFID tag is embedded into the string or tube.

In another embodiment, the retainer is in the form of a string made from a conductive material such as metal (e.g. copper) with one end attaching to the hearing aid and the other end attaching to clothing. The metal string forms a part of the dipole antenna that is electrically connected to the RFID microchip to form an RFID tag.

The RFID tag is passive and communicates with an RFID reader in the far-field using backscatter modulation. The RFID tag is designed to communicate with the reader at distances of 10 feet or more.

In another embodiment, one end of the retainer is attached to the hearing aid while the other end does not have a clip for attaching to clothing. The retainer can be wrapped around the ear of the wearer. The retainer string or tube can be made of elastic material to provide a snug fit around the ear.

In another embodiment, the retainer is not in the form of a string, but in the form of a device that attaches to the hearing aid and sits behind the ear of the wearer. In this embodiment, the entire RFID tag, including microchip and antenna, is assembled on a dielectric substrate and is packaged into the retainer device.

In another embodiment, the RFID microchip uses battery-assisted-passive (BAP) technology and is electrically connected to a battery embedded within the body of the retainer In another embodiment, the RFID microchip uses battery-assisted-passive (BAP) technology and is electrically connected to the hearing aid battery when the retainer is attached to the hearing aid.

The various embodiments of the RFID-equipped retainer are intended for use with an RFID system for preventing the loss of hearing aids. One embodiment of this system can be used environments such as nursing homes, assisted living facilities, and hospitals.

DETAILED DESCRIPTION OF THE INVENTION

The present invention addresses the need for a loss prevention and location system for misplaced hearing aids. The need for this system is particularly acute in long-term care settings, where loss is a frequent and painful problem. While RFID technology has been widely used in loss prevention and the tracking of assets in various environments, the lack of a viable RFID tag has impeded the use of RFID technology for tracking hearing aids.

Hearing aids can be very small in size and are often customized to snugly fit in or around the ear of the wearer. Conventional RFID tags that are used for tracking other assets are, as a result, not well-suited for hearing aids. To enable a practical and viable loss prevention system, the RFID tag for hearing aids should be capable of being detected by an RFID reader at long distances (10 feet or more). The tag should not interfere with the fit, feel or performance of the hearing aid. Furthermore the tag should not emit any wireless signals that will lead to a malfunction of the hearing aid or pose any risk to the wearer.

Figure 1:
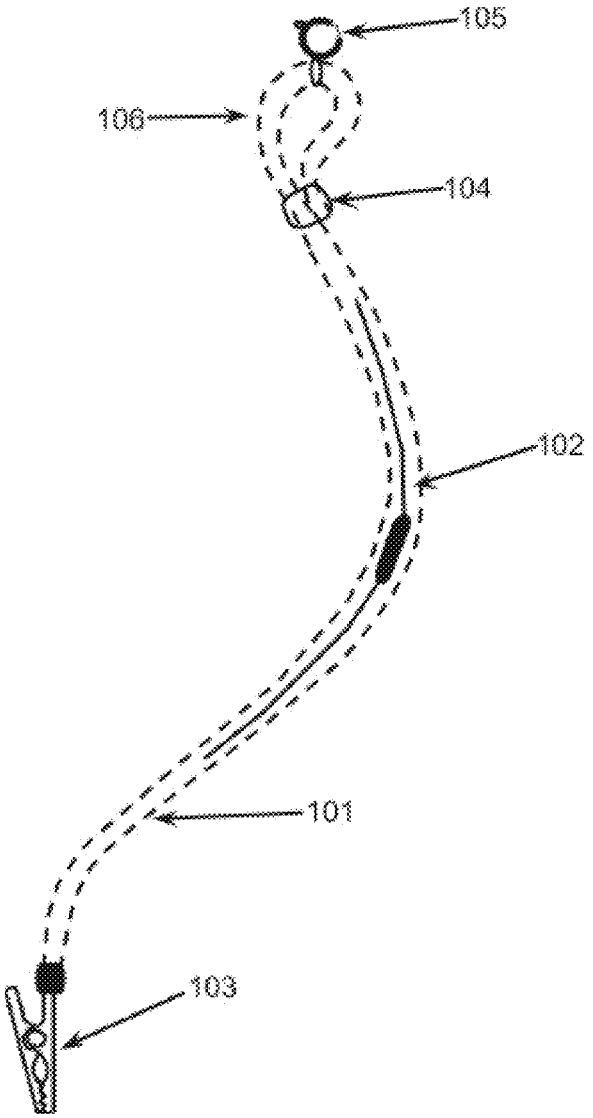
FIG. 1. illustrates the RFID-equipped retainer in accordance with one embodiment of the present invention wherein the retainer is in the form of a hollow string or tube made of non-conductive material.

FIG. 1. shows an RFID-equipped hearing aid retainer in accordance with one embodiment of the present invention. The retainer is made of a hollow string or tube 101, which is made of a non-conductive material such as cloth (e.g. nylon), plastic, rubber, or silicone. In an embodiment of the present invention, the string has an outer diameter of 28 AWG. The hollows string 101 has an RFID tag 102 embedded inside. One end of the string 101, has an alligator clip or similar fastener 103 used to optionally attach the retainer to clothing. The other end of the retainer is threaded through a section of tubing 104 and a clasp 105, and then connected (e.g. glued) back to the inside of tubing 104 to form an elliptical loop 106. The circumference of the loop 106 is adjustable (to accommodate the variable ear-to-clothing distances of individual wearers). The clasp 105 is used to attach the retainer to an eyelet, hook, or clothing loop mounted on the surface of in-the-ear (ITE) and in-the-canal (ITC) hearing aids. Retainers for behind-the-ear (BTE) hearing aids will not require clasp 105.

Figure 2:
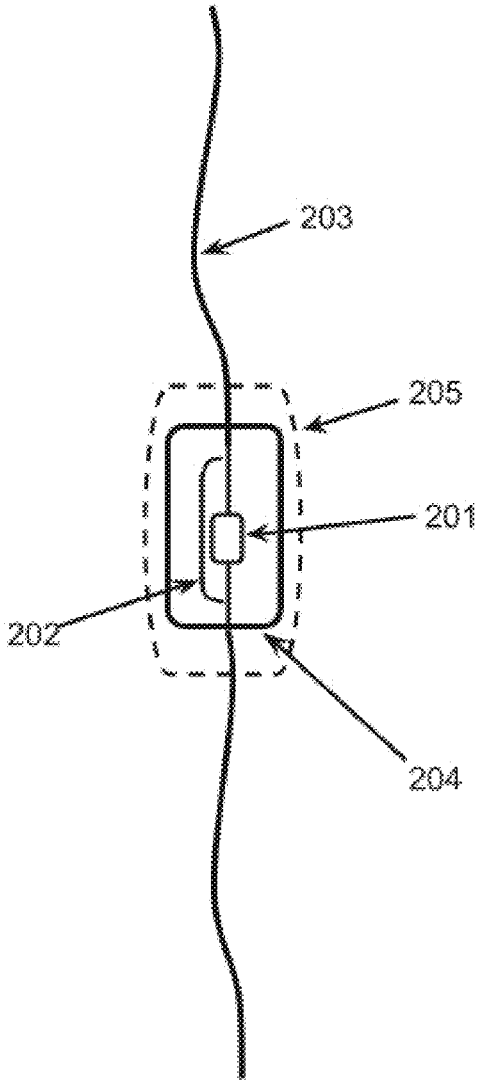
FIG. 2. illustrates an RFID tag in accordance with one embodiment of the present invention. The tag consists of a chip, feeding circuit, dielectric substrate and wire antenna.

FIG. 2. shows the construction of RFID tag 102, which is embedded within the string 101. It is made up of an RFID microchip 201, a feeding and impedance matching circuit 202, and a wire dipole antenna 203. The RFID microchip 201 and feeding circuit 202 is mounted on a flexible or rigid dielectric PCB substrate 204. The RFID microchip does not have a power source. It harvests the power required for operation from the signal emitted by the RFID reader. The feeding and impedance matching circuit optionally consists of a combination of passive elements like inductors and capacitors. The substrate 204, on which the RFID microchip is mounted, is covered with a protective conformal coating 205 to give it protection against dust, moisture, and vibrations. In one embodiment of the present invention, the matching circuit is built using microstrip elements. In another embodiment of the present invention, the matching circuit is built using lumped components. The antenna 203 is electrically connected to the microchip and feeding circuit. In one embodiment of the present invention, the antenna is made of flexible copper braid.

The length of the wire dipole antenna is determined by the wavelength of the RF signal emitted by the RFID reader in the system. In one embodiment of the invention, the length of the wire dipole antenna is at most equal to half the wavelength of the RF signal emitted by the RFID reader. In one embodiment of the invention, the length of the dipole antenna is tuned to a signal from the reader in the frequency range of 902-928 MHz. The dimensions of the string are such that the whole tag can be embedded into the string 101.

Figure 3:
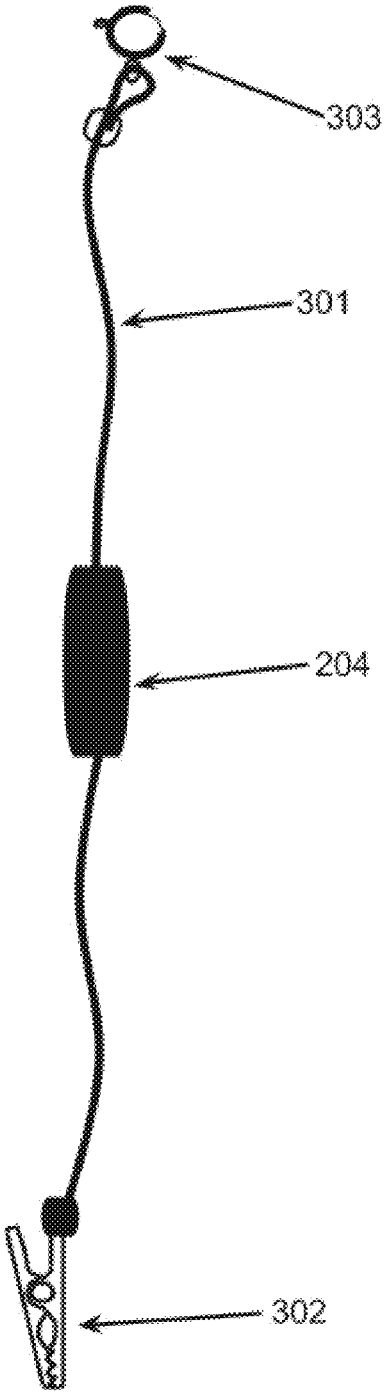
FIG. 3. illustrates the RFID-equipped retainer in accordance with one embodiment of the present invention wherein the retainer is in the form of a string made of a conductive material.

FIG. 3. shows the RFID-equipped hearing aid retainer 301 in another embodiment of the invention. In this embodiment, the retainer string is made out of a conductive material (e.g., flexible copper braid) and it serves as the antenna of the RFID tag. The string is split in the center by the RFID microchip and feeding circuit PCB 204, which is electrically connected to both segments of the retainer string. In one embodiment, the PCB 204 is covered with a conformal coating to protect it from moisture, dust and vibrations. One end of this retainer has an alligator clip or similar fastener 302 for optionally attaching to clothing. The other end of the retainer has a clasp 303 for attaching to ITE and ITC hearing aids.

Figure 4:
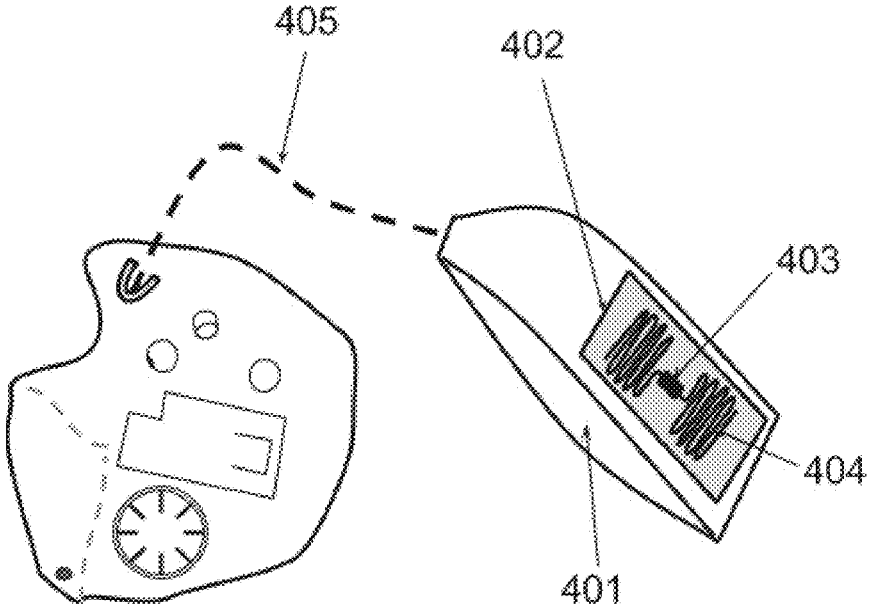
FIG. 4. illustrates the RFID-equipped retainer in accordance with one embodiment of the present invention wherein the retainer is in the form of a device that sits behind the ear.

FIG. 4. shows the RFID-equipped hearing aid retainer 401 in another embodiment of the present invention. The retainer is in the form of a device that sits behind the ear of the wearer. An RFID tag 402 is enclosed in the retainer device. RFID tag 402 consists of an RFID microchip 403 and a printed dipole antenna 404. The printed antenna and the microchip are assembled on a rigid or flexible PCB substrate. In a preferred embodiment, retainer 401 is used for ITE and ITC hearing aids. The retainer has a cord 405 to attach to the hearing aid. Cord 405 can be made of elastic or flexible material that allows a snug fit around the ear of the wearer. The body of the retainer 401 is shaped so that it can fit behind the ear of the wearer. In one embodiment, the body of the retainer 401 is made of a material similar to that used in manufacturing hearing aid shells.

In another embodiment of the present invention, the RFID microchip used in the hearing aid retainer is battery-assisted-passive (BAP). This microchip gets the power required for operation from a small battery while still communicating with the reader passively using backscatter modulation.

Figure 5:
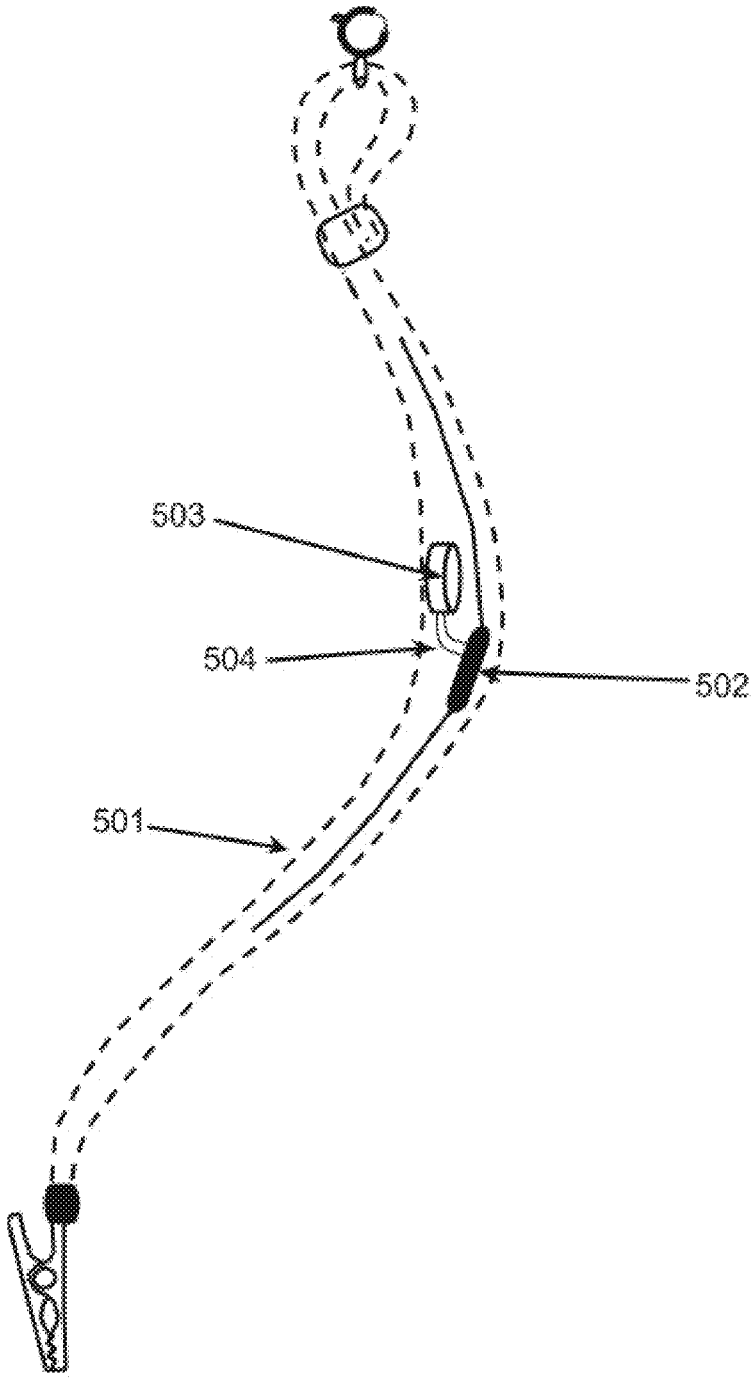
FIG. 5. illustrates the RFID-equipped retainer in accordance with one embodiment of the present invention wherein the tag in the retainer is battery-assisted-passive and is powered by a battery contained within the retainer.

FIG. 5. shows a BAP RFID retainer 501 in accordance with one embodiment of the present invention. The retainer is similar in construction to retainer 101. The difference between retainer 101 and retainer 501 is that the RFID tag embedded within the retainer 501 includes a BAP RFID microchip 502 instead of a passive RFID microchip 201. In order to power microchip 502, the retainer further contains a battery 503, which is electrically connected to microchip 502 with conductor wires 504.

Figure 6:
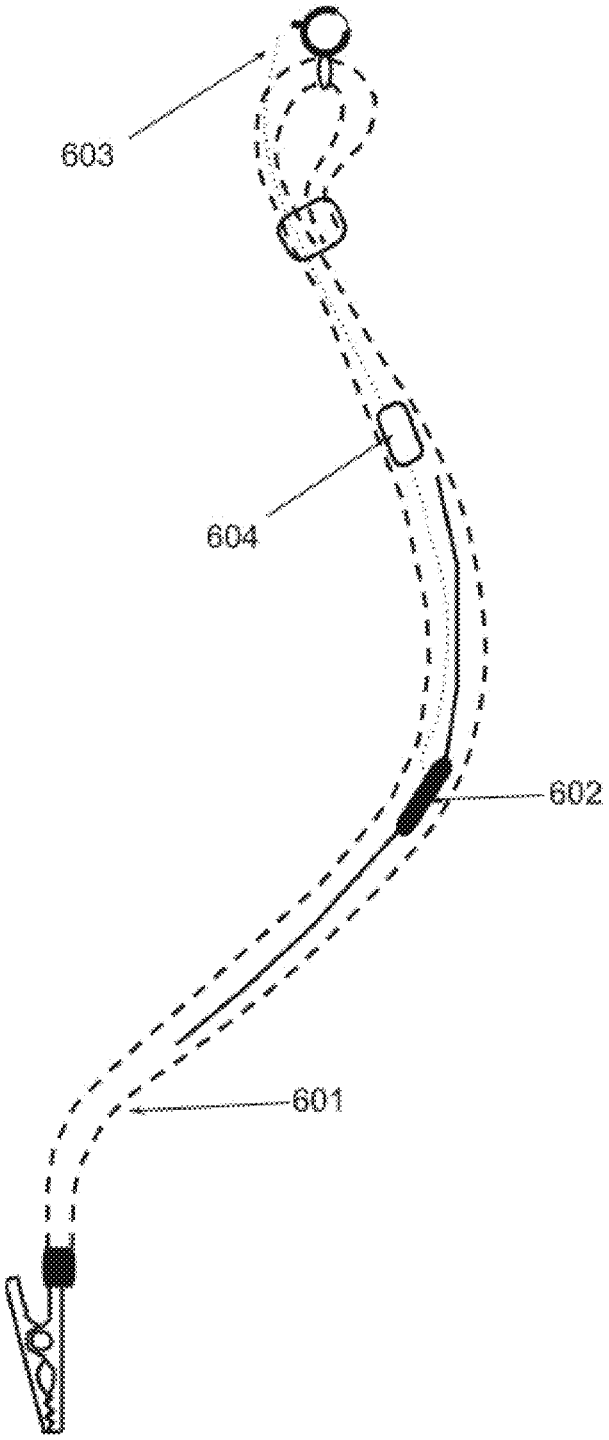
FIG. 6. illustrates the RFID-equipped retainer in accordance with one embodiment of the present invention wherein the tag in the retainer is battery-assisted-passive and is powered by the battery in the hearing aid.

FIG. 6. shows a BAP RFID retainer 601 in accordance with another embodiment of the invention. This retainer includes a BAP RFID microchip 602 mounted on a substrate connected to a dipole antenna. The retainer further contains wire terminals 603, which electrically connect the microchip 602 to the hearing aid battery terminals when the retainer is attached to the hearing aid. The retainer can include a voltage regulation circuit 604 to match the output voltage level of the hearing aid battery to the input voltage required by the BAP RFID microchip 602.

In another embodiment of the present invention, the string of retainer 101 can be in the form of an elastic or rubber-band like material, which allows the string to be optionally wrapped around the ear of the wearer rather than attach to the clothing of the wearer. The retainer string can also be in the form of a lanyard worn around the neck, a headband, or coiled under the ear to resemble an earring. This string will have the RFID tag 102 embedded within it as in other embodiments.

In an embodiment of the present invention, the passive RFID microchip used in the retainers mentioned above is compliant with the ISO 18000-6C standard available commercially from various vendors (e.g. NXP UCODE, Impinj Monza, Alien Higgs)

The BAP RFID microchip can be used in place of the passive microchip to increase the reading distance, reduce the tag antenna size, or both. In one embodiment, this microchip is compliant with the ISO 18000-6C standard, and can be chosen from one of the commercially available product lines such as Impinj Monza, NXP UCODE or EM Micro.

Figure 7:
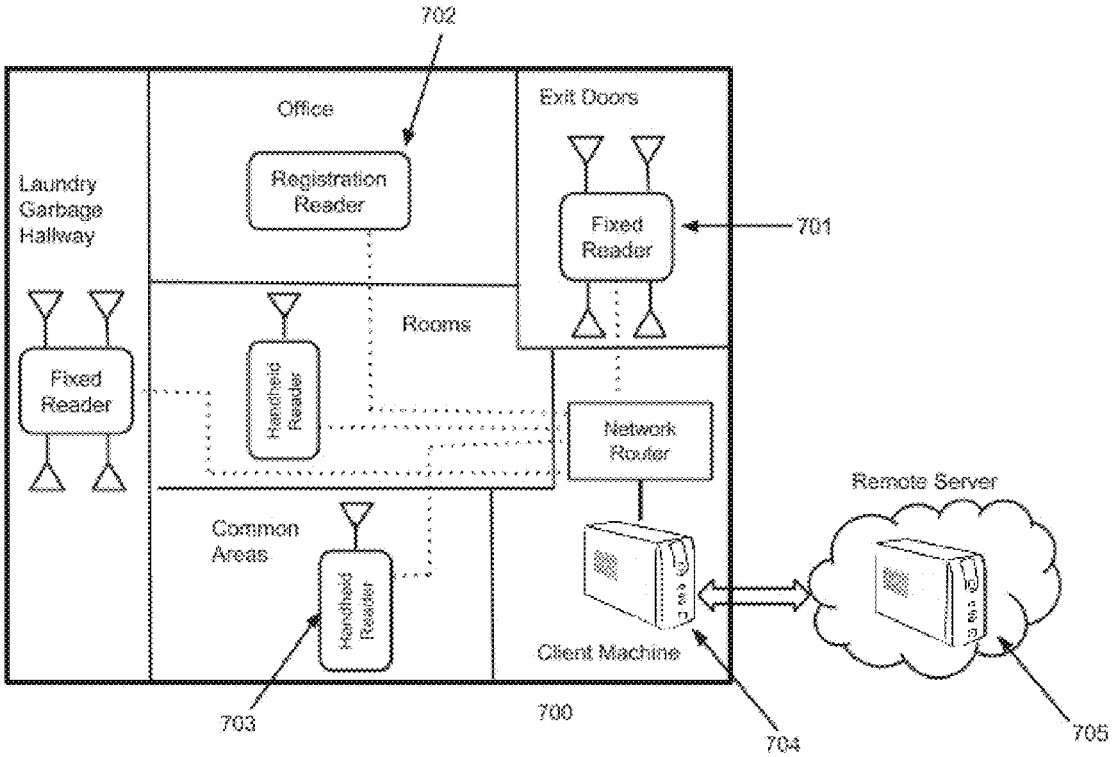
FIG. 7 shows an RFID system that can be used in conjunction with the RFID-equipped hearing aid retainer for preventing the loss of hearing aids.

FIG. 7 shows a block diagram of an RFID system 700 that can be used in long-term care environments in accordance with one embodiment of the present invention. The system includes fixed scanners (consisting of RFID reader and antennas) 701 mounted at strategic locations, handheld scanners 703 for scanning other areas of the facility, registration readers 702 for programming identification information into tagged hearing aids, an internal system controller or client machine 704, and a remote server 705, which hosts a database and a web-based user interface application. The client machine 704 runs all the programs to control the operation of the readers within the facility and also controls communication with the external remote server 705. All the readers (fixed scanners, handheld scanners and registration readers) communicate with the client machine over the facility's internal network. The Remote server 705 hosts a web application and a database that allows users to access and control the system deployed within a facility simply by using a web browser on their computers or mobile devices.

The registration device 702 can be used in conjunction with the system software to program identification information into the RFID microchip and to "register" this information along with associated information about the hearing aid in the database. The associated information can include the name of the owner, the type and/or serial number of the hearing aid, the room number of the owner, and any other relevant information. The fixed readers mounted at strategic locations are programmed to scan for registered RFID tags in their vicinity. The readers can detect the RFID-equipped retainers attached to hearing aids upto a distance of 10 feet or more from the antenna of the reader. The fixed readers can be mounted at various "checkpoints"—areas or points by which hearing aids would not pass unless they are lost or misplaced, such as by facility exit doors or in hallways through which laundry and garbage pass before leaving the facility. When a registered tag is detected, the system can generate a variety of alerts. These alerts include among others, audio and visual alarms, pop-up messages on the web-based software application, emails, text messages and voice messages. The alerts can be used to inform staff members and workers about the detection of the hearing aid at a checkpoint so that they can take steps to retrieve it.

Another component of the system is the portable handheld scanner 703. This scanner can be used by staff members and workers to search for misplaced hearing aids in places such as resident or patient rooms (in closets, drawers, under beds) or common areas. In one embodiment of the system, the handheld scanner is connected to the internet over wifi, and upon detecting a tag, it generates alerts similar to the ones generated by the fixed readers mentioned above. The handheld scanner can be programmed to look for a specific missing tag. The scanner can also have a mode wherein it indicates not only whether a tag is in its range, but how far away it is from the scanner as well. In another embodiment, the handheld scanner connects wirelessly to the facility network and the client machine runs a software that controls and directs the operations of the handheld scanner.

What is claimed is:

1. A radio frequency identification (RFID)-equipped retainer for releasably securing a hearing aid to a wearer, comprising:

a backscattering RFID tag configured to send an identification signal using backscatter modulation in response to a query from an RFID reader, the RFID tag having an RFID microchip configured for storing information related to the hearing aid wearer, and an antenna connected to the microchip for receiving the query signal from the reader and communicating a response to the reader using backscatter modulation; and a retainer body into which the RFID tag is embedded or enclosed, the body having an apparatus for releasably attaching the retainer at one end of the body to the hearing aid and at another end of the body to the wearer.

2. The RFID-equipped retainer of claim 1, wherein the retainer body is configured as one of a hollow string, cord, or tube made from a non-conductive material, such as one of cloth, plastic, rubber, or silicone, within which the RFID tag is embedded.

3. The RFID-equipped retainer of claim 1, wherein the retainer body is in the form of a case or package shaped to sit behind the ear of the wearer, and into which the RFID tag is encased or enclosed.

4. The RFID-equipped retainer of claim 1, wherein the RFID tag antenna is a dipole antenna made of flexible copper braid.

5. The RFID-equipped retainer of claim 1, wherein the RFID tag antenna is printed on a substrate and connected to the RFID microchip mounted on the same substrate.

6. The RFID-equipped retainer of claim 1, wherein the RFID microchip in the tag is passive and requires no battery.

7. The RFID-equipped retainer of claim 1, wherein the RFID microchip in the tag is battery-assisted-passive and is electrically connected to a battery contained within the retainer.

8. The RFID-equipped retainer of claim 1, wherein the RFID microchip in the tag is battery-assisted-passive and is electrically connected to the battery of the hearing aid.

9. The RFID-equipped retainer of claim 2, wherein the retainer wraps around the ear of the wearer or is coiled up under the ear.

10. The RFID-equipped retainer of claim 1, wherein the retainer body is in the form of a sleeve that wraps around the hearing aid.

* * * * *